US005685025A

United States Patent [19]

Chen

[11] Patent Number: 5,685,025

[45] Date of Patent: Nov. 11, 1997

[54] FLUSH CONTROL SYSTEM OF A BALLFLOAT TOILET

[76] Inventor: Tsung-Ming Chen, 1F., No. 2, Alley 19, Lane 184, Kuo Kwang Street, Chungho City, Taipei Hsien, Taiwan

[21] Appl. No.: 633,233

[22] Filed: Apr. 16, 1996

[51] Int. Cl.[6] ..... E03D 1/14

[52] U.S. Cl. ..... 4/325

[58] Field of Search ..... 4/324, 325

[56] References Cited

U.S. PATENT DOCUMENTS 4,115,880 9/1978 Gruenhagen ..... 4/325

4,945,580 8/1990 Schmitt ..... 4/325

*Primary Examiner*—Robert M. Fetsuga

*Attorney, Agent, or Firm*—Varndell Legal Group

[57] ABSTRACT

The ballfloat toilet flush control system includes a master flush handle, a discharge valve controlled by the master flush handle, a float slidably mounted to a float holder, an air tube connected between an air chamber of the discharge valve and an air passage on the float holder, an auxiliary flush handle, and an air passage control device controlled by the auxiliary flush handle. The auxiliary flush handle has an axle spaced from the bottom end of a control member of the passage control device, and moved upwards to force the control member of the air passage control device into engagement with a retaining groove on the supporting frame of the float holder when the auxiliary flush handle is depressed. A locating shell is fixedly mounted inside the water tank to hold the float holder, having a sleeve sleeved onto the shaft of the float to guide its movement and a stop block to limit the upright movement of the upright hollow shaft of the float; the upright hollow shaft of the float is vertically adjustably fixed to the float by a tightening up screw so that the elevation of the upright hollow shaft can be adjusted by loosening the tightening up screw.

4 Claims, 11 Drawing Sheets

FLUSH CONTROL SYSTEM OF A BALLFLOAT TOILET

BACKGROUND AND SUMMARY OF THE INVENTION

The present invention relates to ballfloat toilets, and relates more particularly to the flush control system of a ballfloat toilet which can be alternatively controlled to let water be drawn away from the water tank at two different volumes.

In order to save water consumption, the flush control system of a ballfloat toilet is commonly designed for two-step controls, one for letting water be partially drawn out of the water tank. The ballfloat flush control system of U.S. Pat. No. 5,375,268, which is issued to the present inventor, is a structure of this design (see FIGS. from 1 to 4). This structure of flush control system is functional, however it is complicated to assemble. As illustrated, the axle of the auxiliary flush handle is connected to the second control member by a connecting wire. During the installation of the connecting wire, the length of the connecting wire must be accurately calibrated, and the calibration can be accurately achieved only by experienced engineers. Another drawback of this structure of flush control system is that the connecting wire may not positively transmit power from the axle to the second control member when the auxiliary flush handle is depressed. Furthermore, the float holder, the air passage control device, and the float must be installed separately.

The present invention improves the drawbacks of the ballfloat toilet flush control system of U.S. Pat. No. 5,375,268. According to one aspect of the present invention, the axle of the auxiliary flush handle is spaced from the bottom end of a control member of the air passage control device, and moved upwards to force the control member of the air passage control device into engagement with a retaining groove on the supporting frame of the float holder when the auxiliary flush handle is depressed. According to another aspect of the present invention, a locating shell is fixedly mounted inside the water tank to hold the float holder on the inside, having a sleeve sleeved onto the shaft of the float to guide its movement and a stop block to limit the upright movement of the upright hollow shaft of the float. According to still another aspect of the present invention, the upright hollow shaft of the float is vertically adjustably fixed to the float by a tightening up screw so that the elevation of the upright hollow shaft can be adjusted by loosening the tightening up screw.

DETAILED DESCRIPTION OF THE PREFERRED EMBODIMENT

Figure 1:
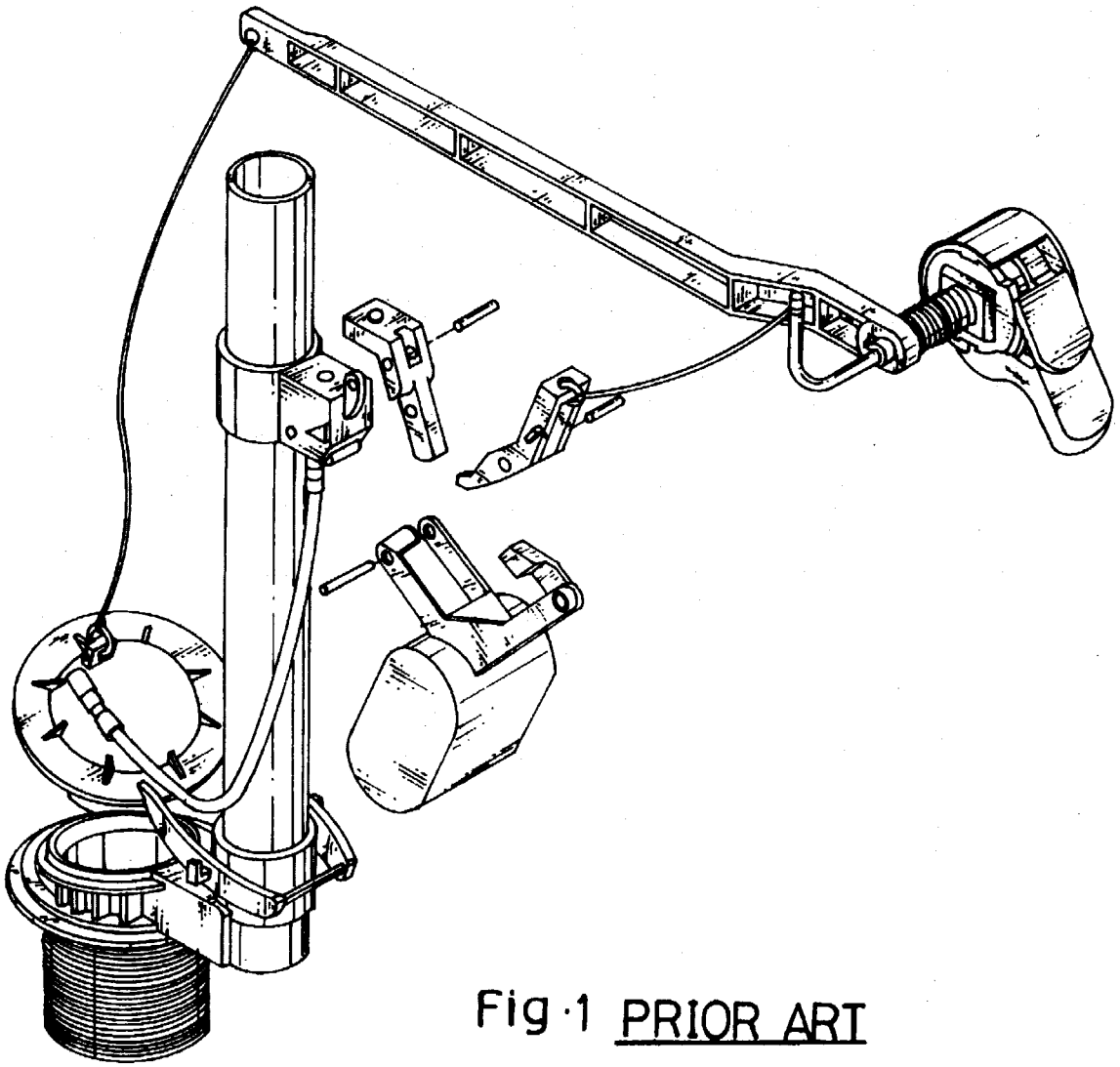
Fig·1 PRIOR ART
FIG. 1 is a perspective view of a flush control system for ballfloat toilet according to U.S. Pat. No. 5,375,268.
Figure 2:
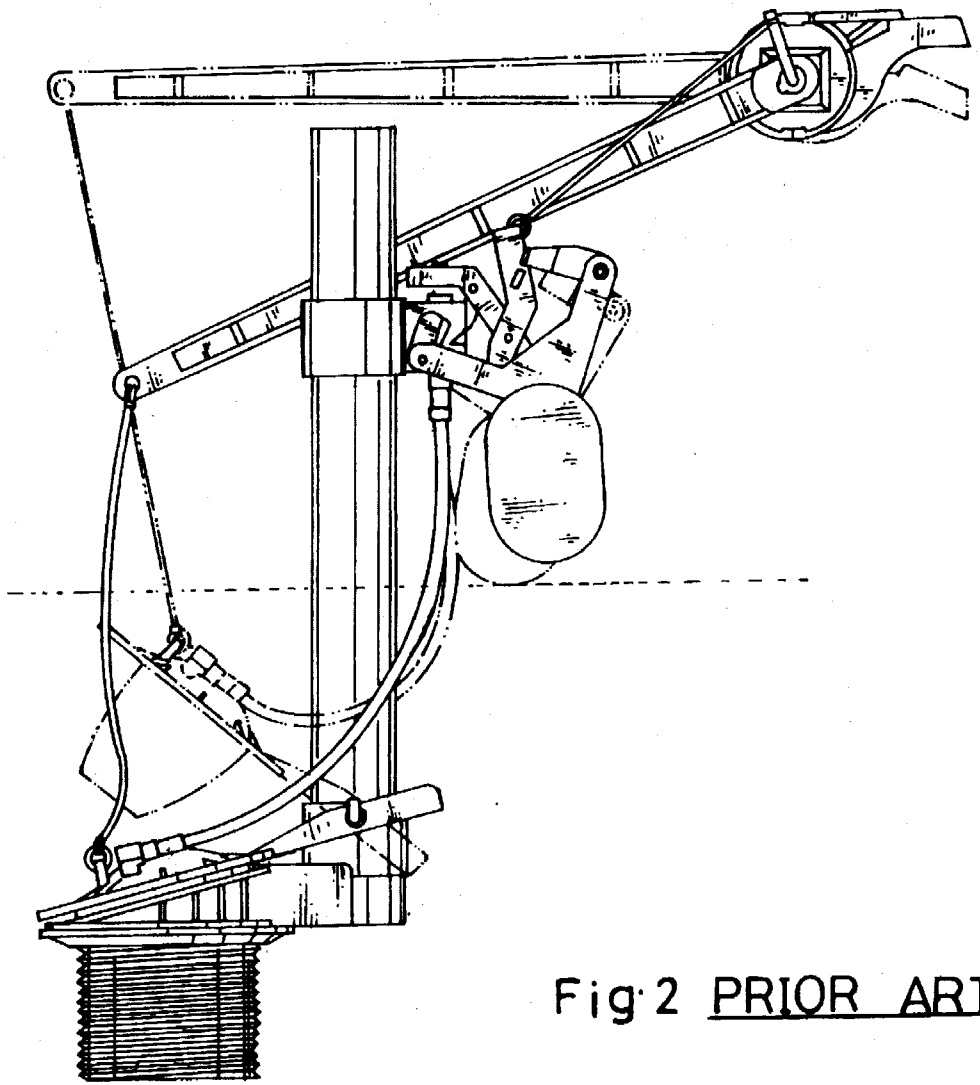
Fig. 2 PRIOR ART
FIG. 2 shows the master flush handle of the flush control system of FIG. 1 pressed.
Figure 3:
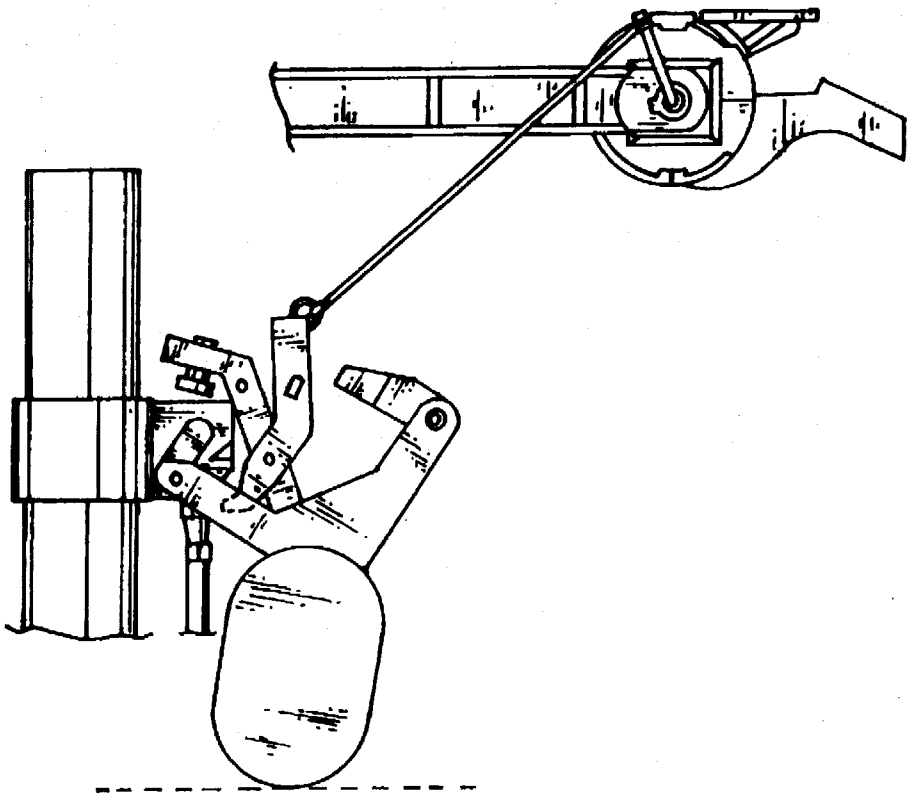
Fig·3 PRIOR ART
FIG. 3 is similar to FIG. 2 but showing the upper portion of the second control member of the air passage control device of the flush control system moved away from the air passage on the float holder.
Figure 4:
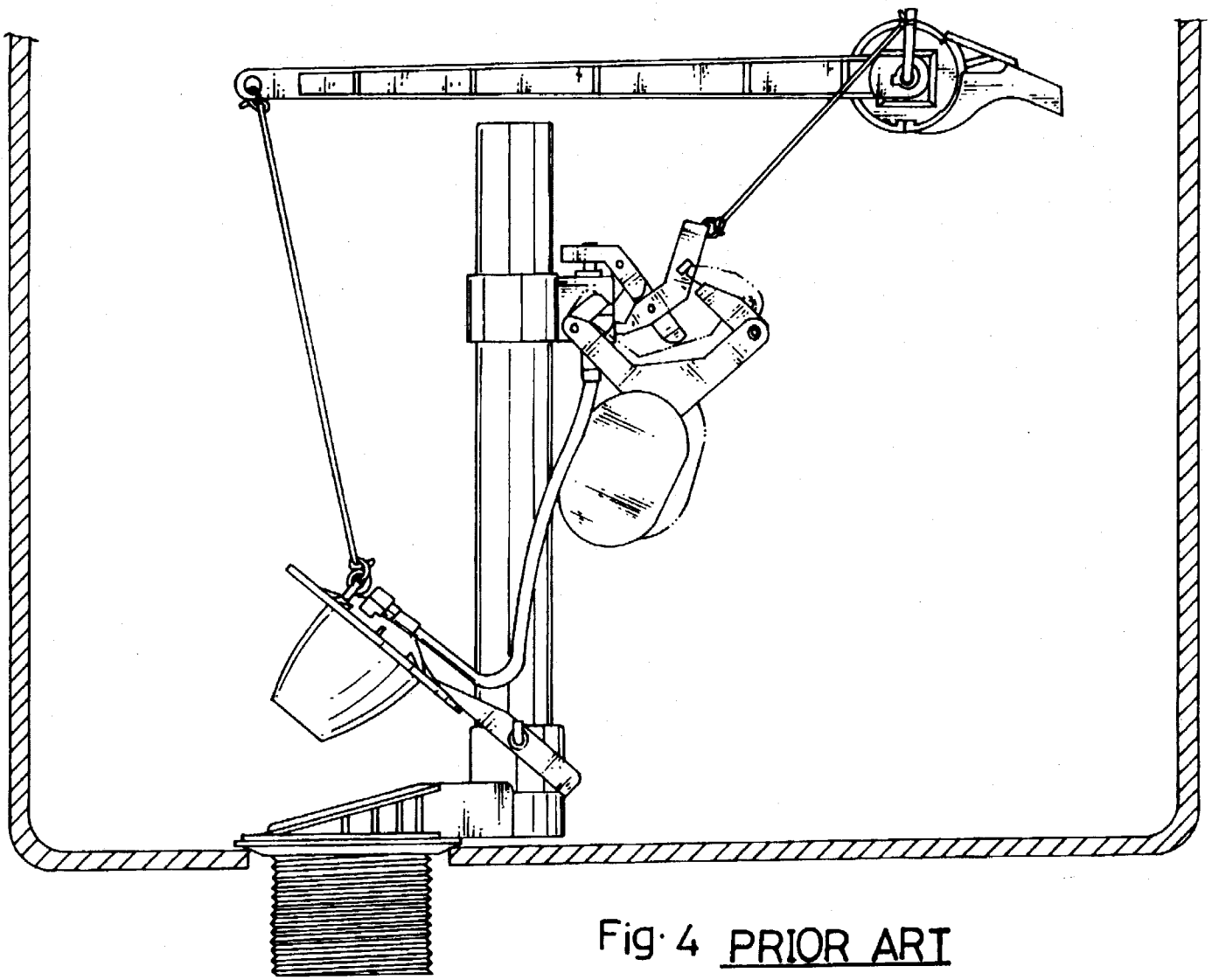
Fig. 4 PRIOR ART
FIG. 4 shows the auxiliary flush handle and master flush handle of the flush control system of FIG. 1 simultaneously pressed and the flush control system of FIG. 1 installed in a water tank.
Figure 5:
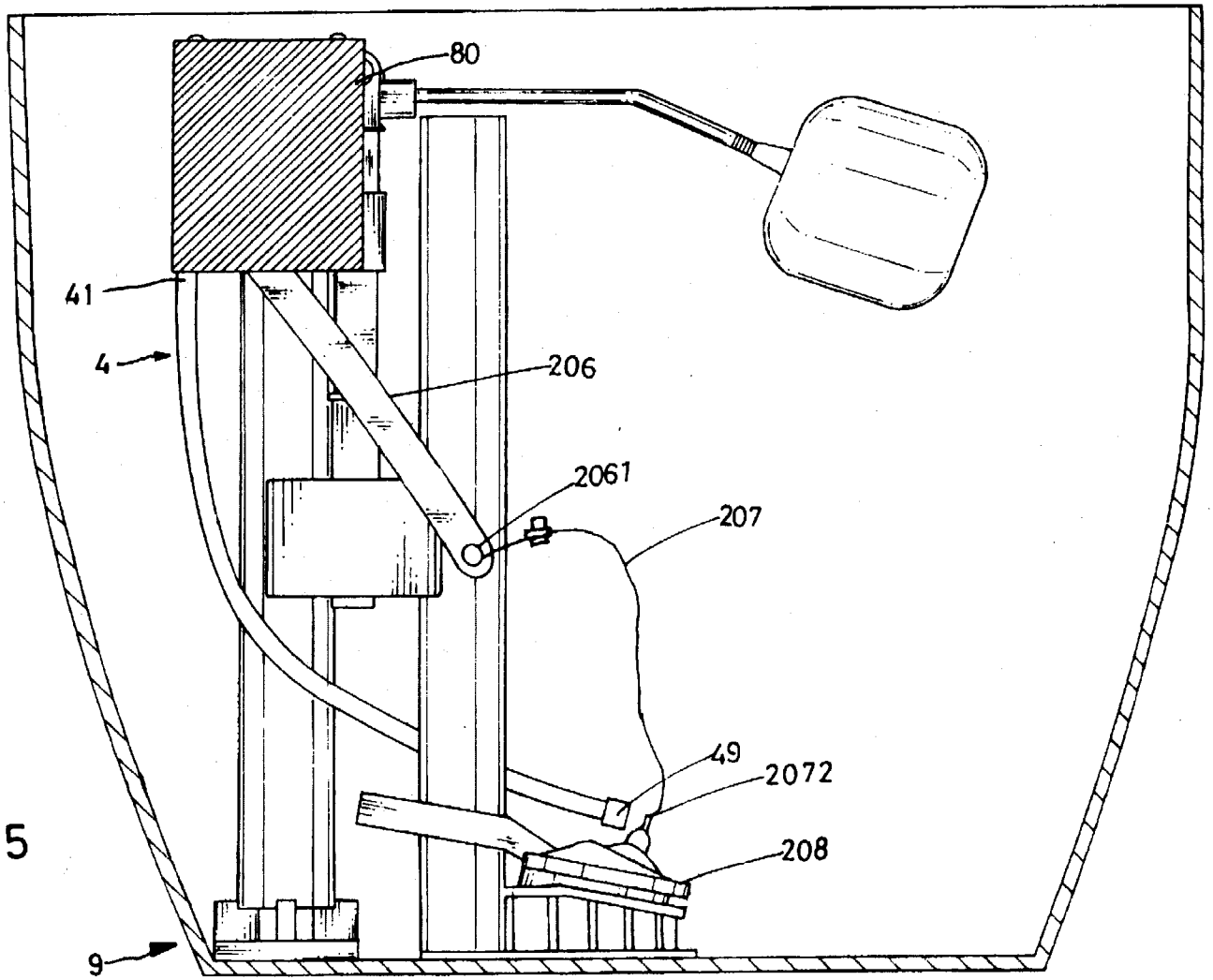
FIG. 5 is a plain view of the present invention showing the flush control system installed in a water tank.
Figure 6:
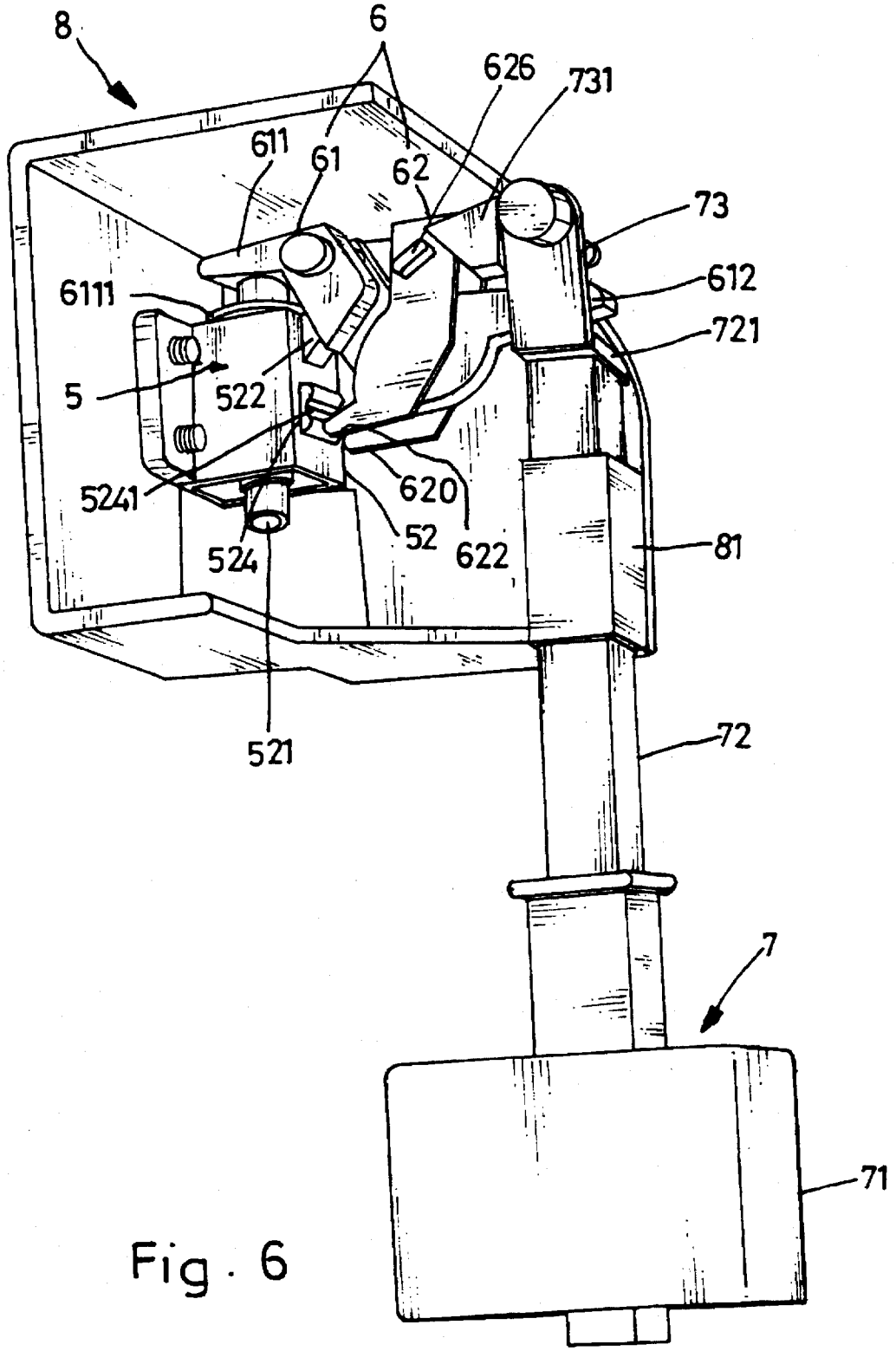
FIG. 6 is a perspective view of the flush control system of FIG. 5, showing the float holder mounted inside the locating shell and the float coupled to the sleeve of the locating shell.

Referring to FIGS. from 5 to 11, a ballfloat toilet in accordance with the present invention is generally comprised of a water supply system and a flush control system. The water supply system is comprised of a water tank, a ball-cock assembly, an inlet tube, an overflow tube, and a float ball assembly. As the water supply system is made according to conventional techniques and not within the scope of the invention, it is neither shown in the drawings nor described in the specification in detail.

The flush control system is installed in the water tank 9 of the water supply system, comprised of a master flush handle, a hollow screw member 203, a link 206, a lift wire 207, a discharge valve 208 having an air chamber (not shown) therein, an air tube 4, an auxiliary flush handle 209, a float holder 5, an air passage control device 6, and a float 7.

The hollow screw member 203 is fastened in a hole (not shown) on the water tank 9 of the water supply system by a nut (not shown) and a packing nut (not shown). The hollow screw member 203 is inserted with a connecting tube (not shown). The connecting tube has one end disposed inside the water tank 9 and coupled to the link 206 and an opposite end disposed outside the water tank and coupled to the master flush handle. The rear end 2061 of the link 206 is fastened with the lift wire 207. The rear end 2072 of the lift wire 207 is connected to the discharge valve 208. The discharge valve 208 has an air chamber (not shown), and is lifted by the lift wire 207 to open the valve seat of the water tank 9 so that a sudden rush of water is sent out of the water tank through the valve seat to wash the toilet bowl. The master flush handle has a recessed chamber (not shown), which receives the auxiliary flush handle 209. The auxiliary flush handle 209 is pivoted about the connecting tube of the hollow screw member 203, having an axle 2092 inserted through the connecting tube of the hollow screw member 203 and extended into the water tank 9. The float holder 5 comprises a supporting frame 52 having an air passage 521, a projecting rod 522 at one side, a hooked portion 524 at the bottom. The air passage control device 6 is comprised of two parts, namely, the first control member 61 and the second control member 62 pivoted together in the middle. The first control member 61 is pivoted to the projecting rod 522 of the supporting frame 52 of the float holder 5, having an upper portion 611 attached with a water sealing pad 6111 for stopping the air passage 521 at the top, and a bottom portion 612 stopped against the float 7. The second control member 62 comprises a bottom hook 622 releasably hooked on the hooked portion 524 of the supporting frame 52 of the float holder 5, and a projecting rod 626 at a suitable location. The float 7 comprises a float chamber 71 at the bottom, a hollow shaft 72 raised from the float chamber 71, and a push rod 73 raised from the top end 721 of the shaft 72. The top end 721 of the shaft 72 is stopped at the bottom portion 612 of the first control member 61 of the air passage control device 6. The push rod 73 has a top end 731 disposed adjacent to the projecting rod 626 on the second control member 62. When the projecting rod 626 of the second control member 62 is pushed by the push rod 73, the second control member 62 is forced to maintain the bottom hook 622 in the hooked portion 524 of the supporting frame 52 of the float holder 5. The air chamber of the discharge valve 208 comprises an air hole (not shown) connected to the bottom end 49 of the air tube 4. The top end 41 of the air tube 4 is connected to the air passage 521 of the supporting frame 52 of the float holder 5.

Figure 7:
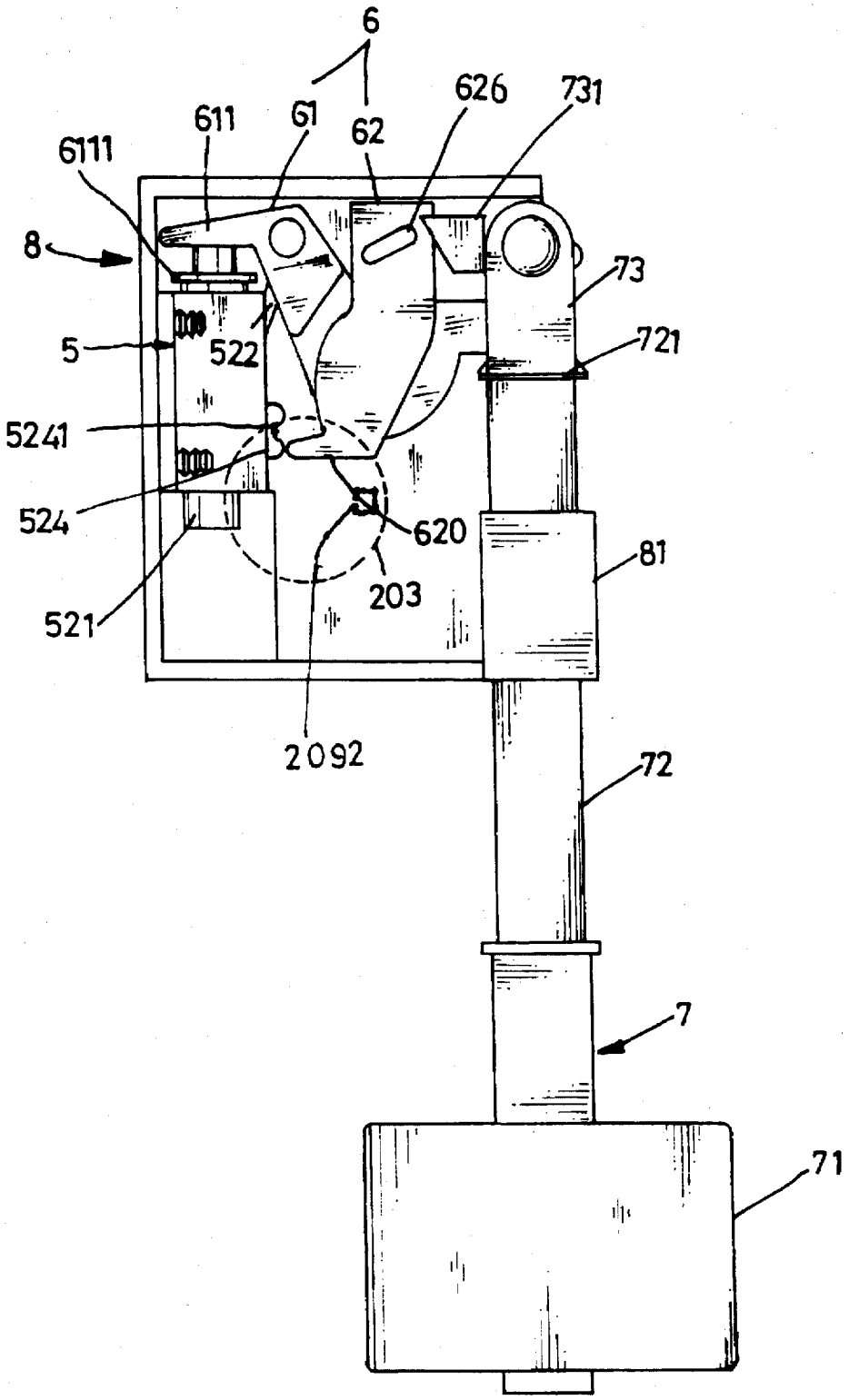
FIG. 7 is a plain view of FIG. 6 when at the full water level position.
Figure 8:
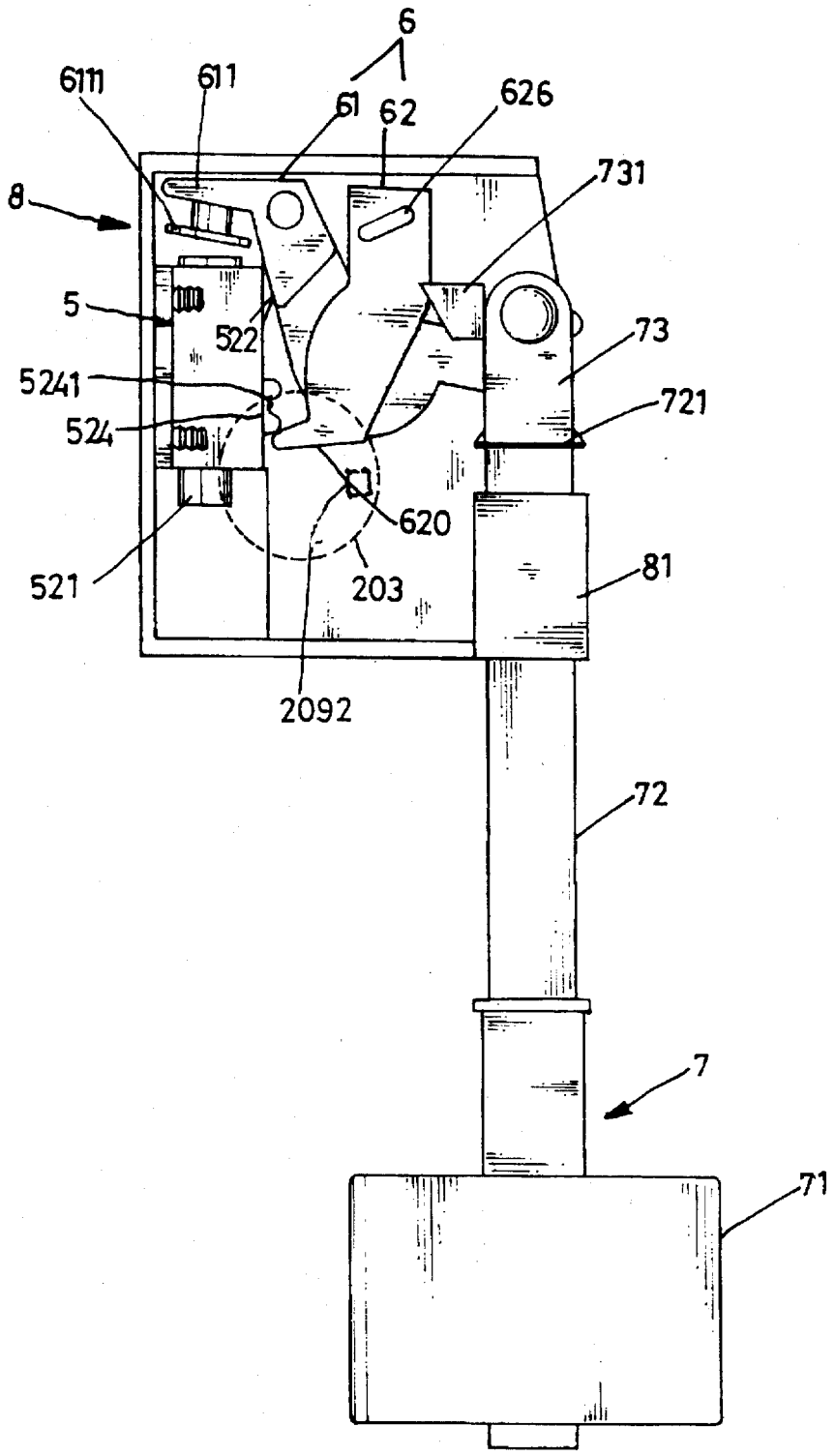
FIG. 8 is another plain view of FIG. 6 when the master flush handle depressed.

The flush control system is alternatively controlled to send a sudden rush of water at different volumes. As the master flush handle is pressed to lift the discharge valve 208 through the link 206 and the lift wire 207 for letting water be drawn away from the water tank 9, the float 7 gradually moves downward. As the float 7 moves downward, the top end 721 of the shaft 72 is released from the bottom portion 612 of the first control member 61, causing the upper portion 611 of the first control member 61 to be moved away from the air passage 521 (see FIG. 8), and therefore water immediately enters the air chamber of the discharge valve 208 as air contained in the air chamber escapes therefrom via air hole, air tube 4 and the opened air passage 521. As water in chamber of the discharge valve 208 is filled up with water, it falls immediately to close the valve seat of the water tank 9, and therefore only a partial volume of water is drawn away from the water tank 9. At the same time, the water level of the float chamber 71 of the float 7 is returned to the normal full level position (see FIG. 7).

Figure 9:
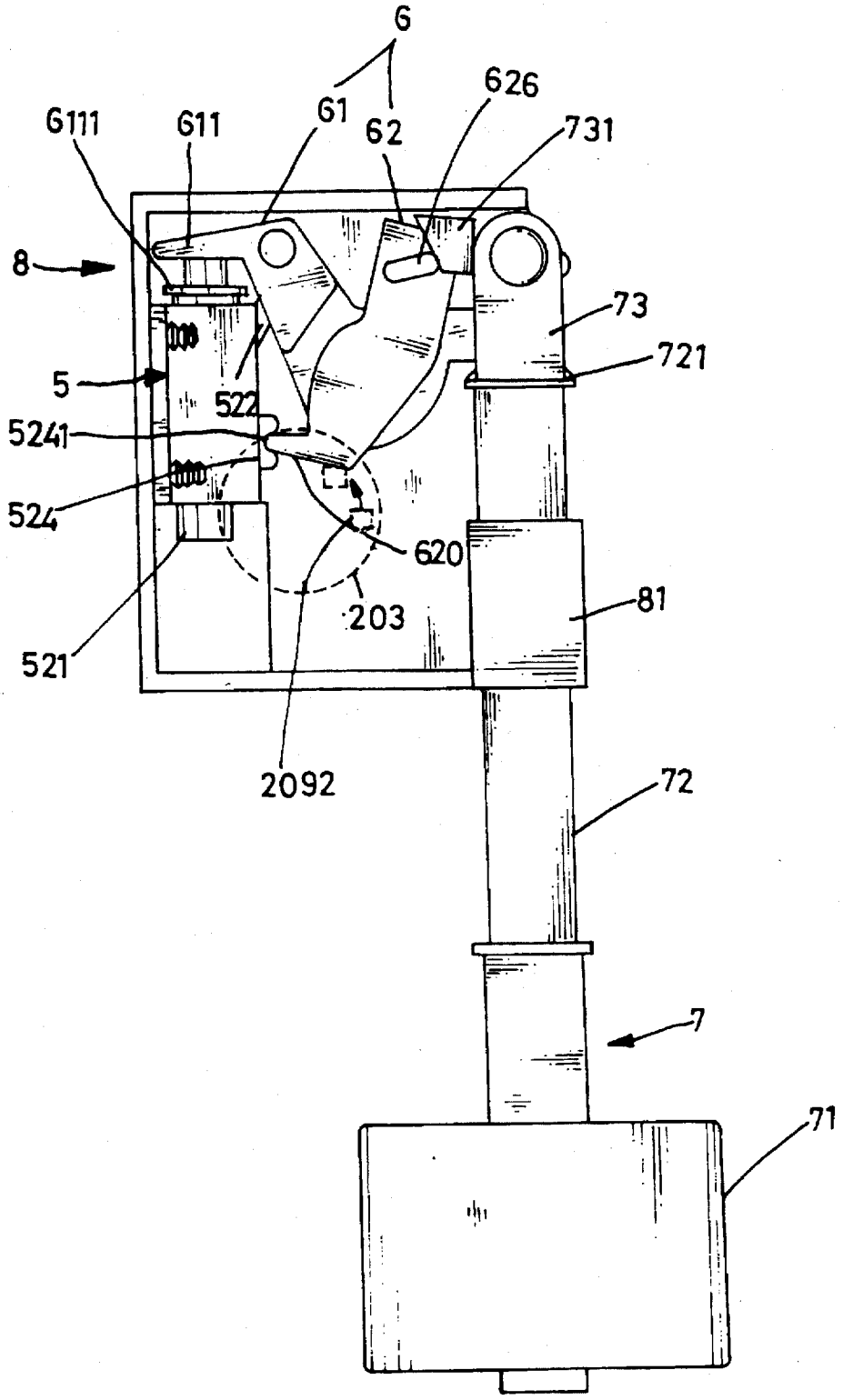
FIG. 9 is still another plain view of FIG. 6 when the auxiliary flush handle depressed.
Figure 10:
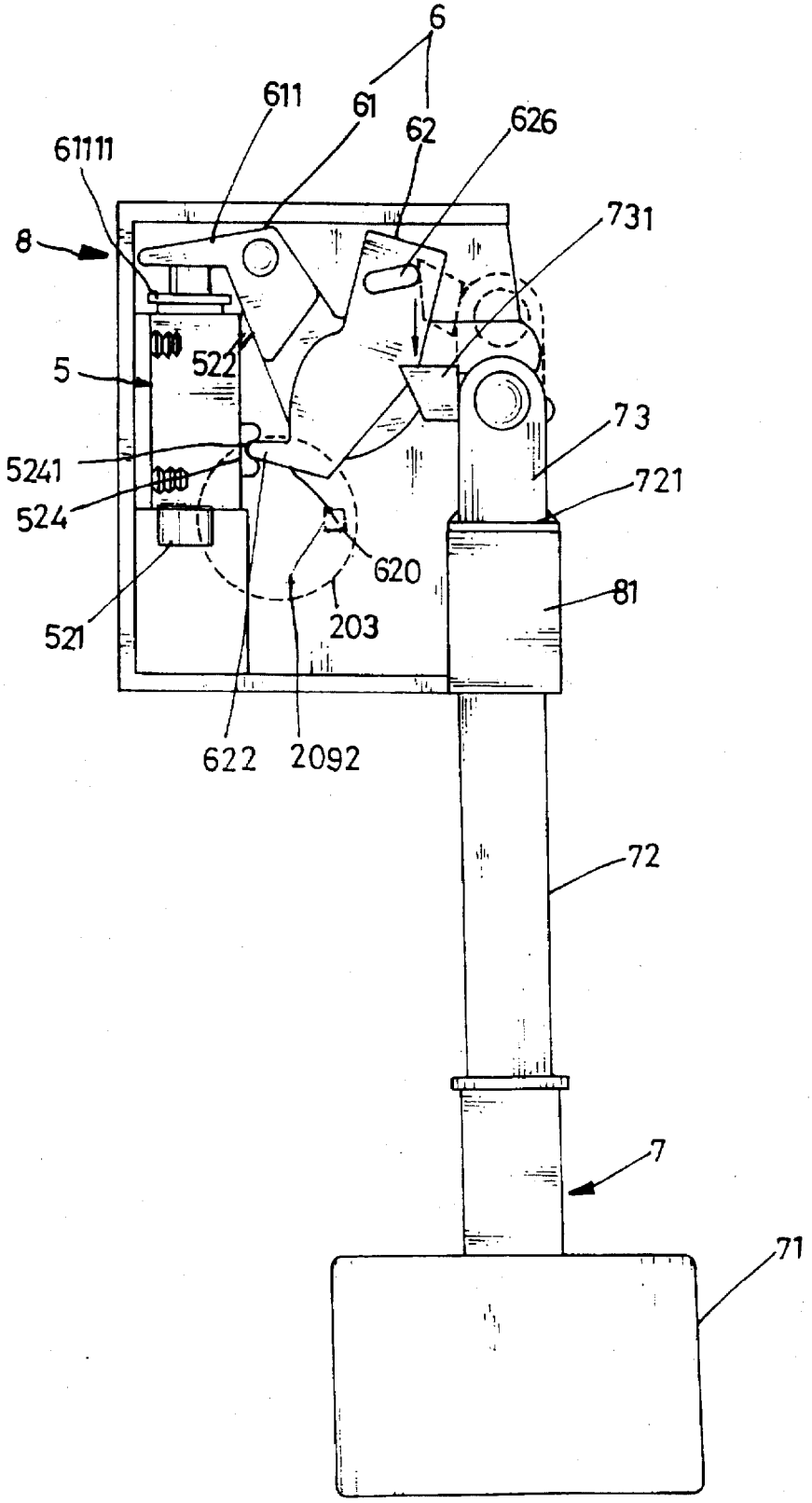
FIG. 10 is similar to FIG. 9 but showing the float moved to the lower limit position.
Figure 11:
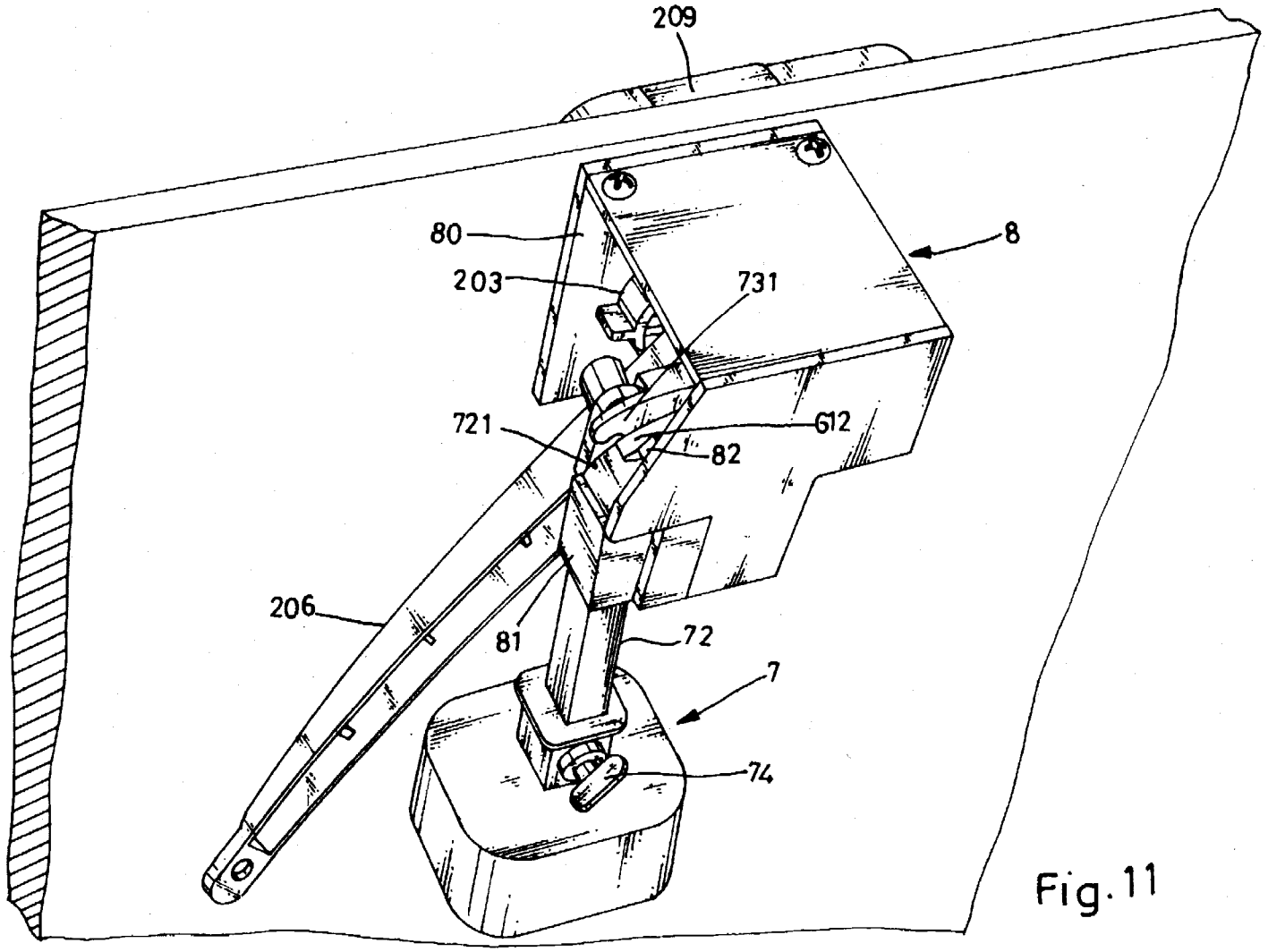
FIG. 11 is a perspective view of the present invention, showing the flush control system fixed to the inside wall of the water tank.

As the auxiliary flush handle 209 is pressed, the master flush handle is simultaneously pressed, and therefore the lift wire 207 is pulled by the link 206 to lift the discharge valve 208 from the valve seat for permitting water be drawn away from the water tank, and at the same time, the axle 2092 of the auxiliary flush handle 209 is forced to move the bottom hook 622 of the second control member 62 to hook on the hooked portion 524 (see FIG. 9). Therefore the upper portion 611 of the first control member 61 is forced by the second control member 62 to maintain the air passage 521 of the hollow supporting frame 52 of the float holder 5 closed by preventing the float 7 from moving downward. As water is completely drawn out of the water tank, the water supply system is immediately activated to supply water to the water tank again, causing the flush control system to return to its former position (see FIG. 10).

The main features of the present invention are outlined hereinafter. The axle 2092 of the auxiliary flush handle 209 is spaced from the bottom end 620 of the second control member 62 of the air passage control device 6. When the auxiliary flush handle 209 is depressed, the axle 2092 is moved upwards to force the bottom hook 622 of the second control member 62 into engagement with a center retaining groove 5241 on the hooked portion 524 of the supporting frame 52. The float holder 5 is fixedly mounted inside a locating shell 8. The locating shell 8 has a mounting frame 80 at one side fixedly secured to the inside wall of the water tank 9, a sleeve 81, which receives the shaft 72 of the float 7, and a stop block 82, which limits the upward movement of the shaft 72 of the float 7. The top end 721 of the shaft 72 is flanged. When the float 7 is moved downwards, the flanged top end 721 of the shaft 72 will be stopped above the sleeve 81 of the locating shell 8 to prevent disconnection of the shaft 72 of the float 7 from the sleeve 81 of the locating shell 8. Furthermore, the shaft 72 is fixed to the float 7 by a tightening up screw 74. When the tightening up screw 74 is loosened, the elevation of the shaft 72 can be changed relative to the float 7. When adjusted, the tightening up screw 74 is fixed tight again to fix the shaft 72 at the adjusted elevation.

I claim:

1. A flush control system for use in a ballfloat toilet having a water tank with a valve seat and an overflow tube for controlling an amount of water suddenly flushed out of said water tank through said valve seat, said flush control system including a master flush handle adapted to be externally arranged on said water tank, a link coupled to said master flush handle, a discharge valve adapted to be mounted to said valve seat having an air chamber therein connected to said link by a lift wire and controlled by said master flush handle to open and close said valve seat, an auxiliary flush handle received in a hole on said master flush handle hand having an axle extended into said water tank, a float holder adapted to be mounted on said overflow tube, an air passage control device pivoted to said float holder and connected to said auxiliary flush handle, a float slidably mounted to said float holder, and an air tube having a first end connected to said discharge valve and communicating with said air chamber and an opposite end connected to said float holder, said float holder comprising a supporting frame having an air passage connected to said air tube, a hooked portion at a bottom side, said air passage control device comprised of a first control member and a second control member pivoted to said float holder, said first control member having an upper portion opening and stopping said air passage, and a bottom portion disposed against said float, said second control member comprising a bottom hook raised from a bottom end thereof and releasably hooked on said hooked portion of said supporting frame, and a projecting rod, said float comprising a float chamber, an upright hollow shaft having a bottom end connected to said float chamber and a top end, and a push rod raised from the top end of said upright hollow shaft, the top end of said upright hollow shaft being disposed against the bottom portion of said first control member, said push rod having a top end disposed adjacent to the projecting rod of said second control member, wherein:

the hooked portion of said supporting frame having a center retaining groove;

the axle of said auxiliary flush handle is spaced from the bottom end of said second control member of said air passage control device, and moved upwards to force the bottom hook of said second control member into engagement with the center retaining groove on the hooked portion of said supporting frame when said auxiliary flush handle is depressed;

a locating shell is fixedly mounted inside said water tank to hold said float holder on the inside, said locating shell having a mounting frame at one side securable to the inside of said water tank, and a sleeve sleeved onto the upright hollow shaft of said float to guide its movement.

2. The flush control system of claim 1 wherein said locating shell has a stop block disposed above the upright hollow shaft of said float to limit its upward movement.

3. The flush control system of claim 1 wherein the top end of the upright hollow shaft of said float has an outward flange of diameter relatively bigger than the inner diameter of the sleeve of said locating shell.

4. The flush control system of claim 1 wherein said upright hollow shaft is vertically adjustably fixed to said float by a tightening up screw.

* * * * *